US005366121A

United States Patent [19]

Foster et al.

[11] Patent Number: 5,366,121

[45] Date of Patent: Nov. 22, 1994

[54] UNIVERSAL HOUSING FOR FLUID DISPENSER

[75] Inventors: Donald D. Foster, St. Charles; Marvin B. Levy, University City, both of Mo.

[73] Assignee: Contico International, Inc., St. Louis, Mo.

[21] Appl. No.: 844,942

[22] Filed: Mar. 4, 1992

Related U.S. Application Data

[63] Continuation of Ser. No. 530,409, May 30, 1990, abandoned.

[51] Int. Cl.[5] ..... B67D 5/40

[52] U.S. Cl. ..... 222/383

[58] Field of Search ..... 222/383, 182

[56] References Cited

U.S. PATENT DOCUMENTS

| | | | |
|---|---|---|---|
| D. 244,991 | 7/1977 | Weckman et al. | 222/383 |
| 3,820,721 | 6/1974 | Hellenkamp | 222/182 |
| 4,138,038 | 2/1979 | Grogan | 222/383 |
| 4,191,313 | 3/1980 | Blake et al. | 222/383 |
| 4,241,853 | 12/1980 | Pauls et al. | 222/383 |
| 4,257,539 | 3/1981 | Cary et al. | 222/182 |
| 4,454,965 | 6/1984 | Kirk, Jr. | 222/383 |
| 4,781,311 | 11/1988 | Dunning et al. | 222/153 |
| 4,911,361 | 3/1990 | Tada | 222/383 |
| 4,958,754 | 9/1990 | Dennis | 222/383 |
| 5,172,386 | 12/1992 | Warner | 222/383 |

FOREIGN PATENT DOCUMENTS

| | | |
|---|---|---|
| 3234289 | 10/1989 | Australia . |
| 0208390 | 1/1987 | European Pat. Off. . |

*Primary Examiner*—Andres Kashnikow
*Assistant Examiner*—Philippe Derakshani
*Attorney, Agent, or Firm*—Rogers, Howell & Haferkamp

[57] ABSTRACT

A housing for use with a fluid dispensing apparatus adapted for attachment to a fluid container using a snap-action coupler. The housing contains a lower portion configured to extend generally downward over the fluid dispensing apparatus and over at least an upper portion of the fluid container when the housing is attached to the fluid dispensing apparatus and the fluid dispensing apparatus is coupled to the fluid container. At least the lower portion of the housing is configured to substantially complement that portion of the fluid container adjacent the lower portion of the housing when the housing is attached to the fluid dispensing apparatus and the fluid dispensing apparatus is coupled to the fluid container. The housing may be attached to the fluid dispensing apparatus, which may in turn be attached to a fluid container.

15 Claims, 2 Drawing Sheets

UNIVERSAL HOUSING FOR FLUID DISPENSER

This application is a continuation of application Ser. No. 07/530,409 filed May 30, 1990, now abandoned.

BACKGROUND OF THE INVENTION

1. Field of the Invention

The present invention is directed to a universal housing for use with a fluid dispenser, such as a pump bottle or sprayer bottle. The housing is attachable to the fluid dispensing apparatus used to draw fluid from a container holding the fluid and expel it, and is configured in such a manner as to provide the fluid dispensing apparatus and bottle with a unified appearance.

More particularly, the present invention is directed to a housing having a lower portion extending over the coupler used to attach the fluid dispensing apparatus to the fluid container and over at least a portion of the container. This permits the exterior configuration of the housing to be complementary to that of the container, such that the fully assembled fluid dispenser presents a unified appearance.

2. Description of Background and Relevant Materials

Fluid dispensers such as pump bottles, pump spray bottles, and in particular trigger sprayer bottles, are used to dispense a broad range of substances. Those substances include hand, face, and body lotions; and, cleaners for materials as diverse as wood, glass, vinyl, leather, suede, metals (such as aluminum, copper, brass, silver, and chrome), rubber (such as automobile tire brighteners), formica, ceramics, stainless steel, fabrics, painted surfaces, and the like.

Manufacturers of such substances may desire to package their product differently for different markets. Thus, the same cleaner may be packaged with one appearance for the home market, and with a distinctly different appearance for the automotive market. Moreover, certain retailers may wish to carry cleaners packaged as a "house" or generic brand, requiring a manufacturer to provide the same product with a variety of appearances.

In addition, a manufacturer introducing an improved version of a product may wish to alter the packaging of that product to draw attention to its improvement. Alternatively, a manufacturer who has marketed a particular product using a particular appearance may wish to change that appearance, such as to employ a more contemporary look, or to avoid any undue similarity in appearance to a competing product.

Although there is accordingly a need for an inexpensive means for customizing fluid dispensers, the prior art attempts to fill that need suffer from serious drawbacks. CARY et al., U.S. Pat. No. 4,257,539, is directed to a shroud which may be fitted over a component retaining body. However, the interior construction of this shroud which is intended to effect its attachment to the component retaining body is quite complicated. This complexity may be expected to increase the associated manufacturing costs. Moreover, if this shroud is to be fixedly attached to the component retaining body, it is necessary to employ means such as ultrasonic welding, which adds a further manufacturing complication and expense.

An important consideration in the design of such a housing is that the fully assembled fluid dispenser should present an integrated appearance such that the fluid container, fluid dispensing apparatus, and housing seem of a piece. Marketability is enhanced when a product gives the consumer the impression of having been particularly made, in its entirety, rather than of having been assembled from interchangeable parts. Moreover, the visual impact, and hence sales appeal, of a product can be significantly influenced by the appearance of its packaging. The ability to freely manipulate the configuration of the housing to complement that of the fluid container would accordingly be of significant value.

It is therefore an object of the present invention to provide a universal housing for a fluid dispensing apparatus which is simple in construction, yet which provides for a wide range of customization in external appearance.

It is a further object of the present invention to provide such a housing which, when attached to the fluid dispensing apparatus and fluid container, provides a unified appearance.

SUMMARY OF THE INVENTION

There is accordingly provided by the presently claimed invention a housing for use with a fluid dispensing apparatus containing a snap-action coupler for attaching the fluid dispensing apparatus to a fluid container. The housing includes means for attaching the housing to the fluid dispensing apparatus. The housing also includes a lower portion, which is configured to extend generally downward over the fluid dispensing apparatus and over at least an upper portion of the fluid container, when the housing is attached to the fluid dispensing apparatus and the fluid dispensing apparatus is coupled to the fluid container. At least the lower portion of the housing is configured to substantially complement that portion of the fluid container to which the lower portion of the housing is adjacent when the housing is attached to the fluid dispensing apparatus and the fluid dispensing apparatus is coupled to the fluid container.

The present invention includes an embodiment wherein the housing is attached to a suitably configured fluid dispensing apparatus, as well as to an embodiment wherein the attached housing and fluid dispensing apparatus are coupled to a fluid container.

The means for attaching the housing to the fluid dispensing apparatus includes at least one projecting member extending longitudinally with respect to the housing. The projecting member has a fixed end connecting the projecting member to the housing, and a free end adapted to engage the fluid dispensing apparatus. The free end of the projecting member may comprise a snap action fitting, such as a bayonet-type connection. The housing may include two projecting members, which are preferably molded integrally with the housing.

The projecting members may be laterally spaced from the longitudinal axis of the housing, and in such a configuration are preferably symmetrically positioned with respect to the longitudinal axis of the housing. Most preferably, the two projecting members are located in the interior of the housing, substantially adjacent to the upper surface of the housing.

In an alternative embodiment, the two projecting members may comprise a first pair of projecting members, with the housing also including a second pair of projecting members. The first and second pairs of projecting members may be both laterally spaced from, and symmetrically positioned with respect to, the longitudinal axis of the housing.

Most preferably, the first pair of projecting members is located in the interior of the housing, substantially adjacent to the upper surface of the housing, and the second pair of projecting members is located in the interior of the housing below the level of the first pair of projecting members.

In an alternative embodiment, the means for attaching includes at least one discontinuity in the surface of the housing. The discontinuity is adapted to mate with a correspondingly configured discontinuity on the fluid dispensing apparatus when the housing is attached to the fluid dispensing apparatus. Preferably, the discontinuity is an aperture, and may take the form of an indicia, such as an arrow.

The housing may further include means for centering the housing on the fluid dispensing apparatus. These centering means may comprise a horizontal member extending from the interior of the housing and having a front-facing surface adapted to conform to a rear-facing surface of the fluid dispensing apparatus. In this manner, the housing is centered on the fluid dispensing apparatus by engagement of the front-facing surface with the rear-facing surface upon attachment of the housing to the fluid dispensing apparatus.

In a preferred embodiment, the horizontal member comprises a substantially U-shaped front-facing end terminating in two free arms. Each of the two free arms is adapted to engage a corresponding receptacle on the fluid dispensing apparatus in a snap action type engagement. The horizontal member may be integral with the housing along at least a portion of its lateral edges, and may also be integral with the rear wall of the housing. In addition, the horizontal member may include at least one vertical member extending generally downward from the lower surface of the horizontal member to a lower portion of the housing.

In the embodiment wherein the housing of the present invention is attached to a suitably configured fluid dispensing apparatus, and the means for attaching the housing to the fluid dispensing apparatus includes at least one discontinuity in the housing, the fluid dispensing apparatus may include a protrusion configured and positioned to mate with the discontinuity when the housing is attached to the fluid dispensing apparatus.

BRIEF DESCRIPTION OF FIGURES

FIG. 1 provides an exterior right side view of housing 1 and fluid dispensing apparatus 2. The arrow indicates the manner in which housing 1 is associated with fluid dispensing apparatus 2 in the assembled apparatus.

In FIG. 2, housing 1 is shown associated with fluid dispensing apparatus 2 after movement of the housing onto the fluid dispensing apparatus as suggested in FIG. 1.

FIG. 3 provides a top view of housing 1, showing discontinuity 6. The interior structures of projecting members 4 and 4', connectors 5 and 5', and horizontal centering member 7 are indicated by dotted lines.

FIGS. 6A and 6B provide, respectively, left and right side views of one possible embodiment of the housing of the present invention. In these views the housing is attached to the fluid dispensing apparatus, which has in turn been coupled to a fluid container.

FIGS. 7A and 7B provide left and right side views, respectively, of another possible embodiment of the housing of the present invention, in association with both a fluid dispensing apparatus and a fluid container.

DESCRIPTION OF PREFERRED EMBODIMENTS

The universal housing of the present invention may be readily adapted for use with a wide variety of fluid dispensers, including pumps and spray pumps. For purposes of convenience, the housing has been illustrated in the context of a manually operated, trigger-type sprayer bottle. Although the following discussion will accordingly present the invention in this context, and will make reference to the parts of a trigger-type sprayer bottle, it is to be understood that this is for illustrative purposes only, and in no respect constitutes any limitation on the scope of the present invention.

Figure 1:
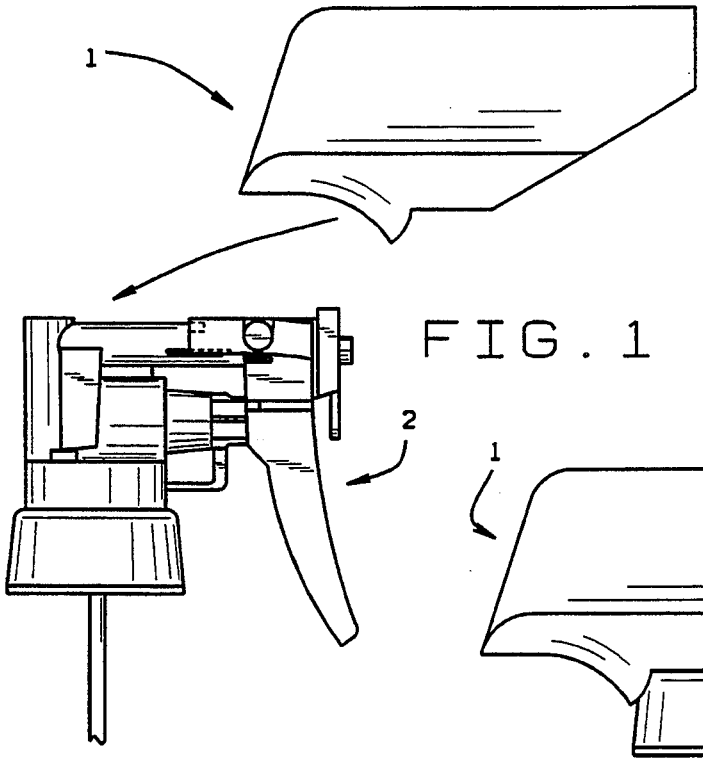
FIG. 1.

As used herein, the term "fluid dispensing apparatus" refers to the apparatus or mechanism used to draw up a fluid from a fluid container and expel it in a desired direction and/or configuration. Thus, for a trigger-type sprayer, the fluid dispensing apparatus would be the trigger sprayer assembly (such as is shown in FIG. 1 as element 2). For a pump-type fluid dispenser, the fluid dispensing apparatus would be the pump mechanism.

The term "fluid container" refers to the container used to store fluid as a reservoir to be drawn upon by the fluid dispensing apparatus. Generally, this will simply be a bottle, which may be, for example, glass or plastic, and which may assume a wide range of shapes, sizes, colors, and configurations without departing from the scope of the present invention.

The term "fluid dispenser" describes the complete assembly of housing, fluid dispensing apparatus, and fluid container. In other words, the fluid dispenser is what the end user would pick up and use to dispense fluid.

In general terms, the objects of the present invention are achieved by providing the housing with at least a lower portion which extends downward, over the coupling between the fluid dispensing apparatus and the fluid container and over at least the upper part of the fluid container. Because the housing extends over the coupling, the coupling used to connect the fluid dispensing apparatus to the fluid container is preferably one which does not require direct manipulation to operate. It is suitable to use, for example, a snap-action or bayonet-type coupling, such as described in DUNNING et al., U.S. Pat. No. 4,781,311, or in European Patent Application No. 86301997.2 (Publication No. 0 208 390). By use of such a coupling, the housing/fluid dispensing apparatus assembly may be connected to and disconnected from the fluid container by applying appropriate forces to the housing, which will transmit them to the coupling.

The housing may be adapted for attachment to the fluid dispensing apparatus via snap-type connectors. The snap-type connectors may be supplemented with an additional attachment point in the form of a discontinuity in the housing surface which mates with an appropriately configured protrusion on the dispenser assembly surface.

The snap-type connectors are preferably bayonet-style connectors, which engage corresponding receptacles on the fluid dispensing apparatus. While the number of connectors used, and their positioning, can vary widely without departing from the scope of the present invention, in its preferred embodiment the housing contains two pairs of connectors; a first pair positioned substantially near the upper surface of the housing, and a second pair positioned below the level of the first pair and above the level of the coupling connecting the fluid dispensing apparatus to the fluid container. The second pair may be associated with means for improving centering of the housing on the fluid dispensing apparatus.

The centering means is preferably in the form of a horizontal member extending from the walls of the housing, such as the interior rear and/or side walls. The horizontal member positioned at a level within the housing that will enable it to contact a selected portion of the fluid dispensing apparatus when the housing is attached thereto. In particular, the front facing end of the horizontal member is shaped to match the corresponding rear facing surface of the selected portion of the fluid dispensing apparatus.

Thus, if the corresponding rear-facing surface of the fluid dispensing apparatus is substantially cylindrical, as in FIG. 1, the front facing end of the horizontal member should be substantially U-shaped to properly and firmly engage the rear-facing surface when the housing is attached to the fluid dispensing apparatus, thereby enhancing centering of the housing on the assembly.

A portion of the front-facing end of the horizontal member may be associated with the second pair of connectors. For example, where horizontal member 7 follows the substantially U-shaped configuration shown in FIG. 4, each arm of the U may be shaped to terminate in a snap connector, thereby forming the second pair of connectors. Naturally, in such a configuration the extent of any connection between the horizontal member and the walls of the housing must be limited to leave the terminal arms free to engage corresponding receptacles suitably located on the fluid dispensing apparatus.

Figure 2:
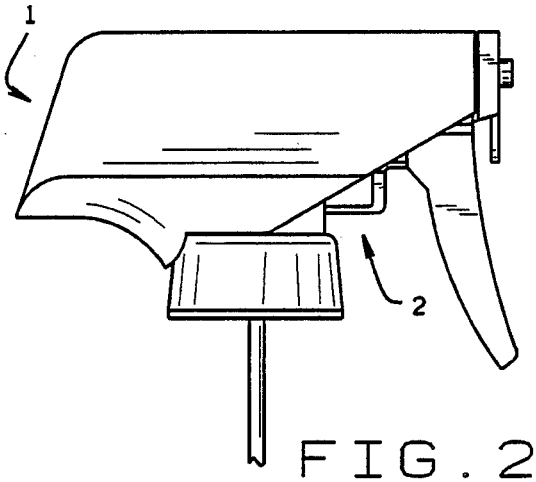
FIG. 2.

More particularly, and with reference now to FIGS. 1 and 2, there is shown a housing 1 and fluid dispensing apparatus 2 which, when coupled to a fluid container, form a manually operated trigger-type sprayer. Housing 1 is adapted to fit over and attach to fluid dispensing apparatus 2 in a manner to be described in greater detail hereinafter.

For practical reasons, the fluid container will generally be of a size to contain no less than about 4 fluid ounces and no more than about 48 fluid ounces. However, the housing according to the present invention may be adapted to a broad range of containers, and the fluid container may accordingly be of any size, shape, and configuration.

Fluid dispensing apparatus 2 may likewise be selected from a broad range of styles. Thus, while a trigger-type fluid dispensing apparatus has been illustrated, the fluid dispensing apparatus may be of any known type, including pumps, pump-sprayers, and aerosol nozzles.

Figure 4:
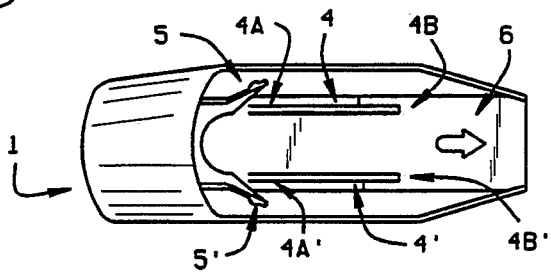
FIG. 4. Housing 1 is shown from a bottom view, looking up into the interior structure of the housing.
Figure 5:
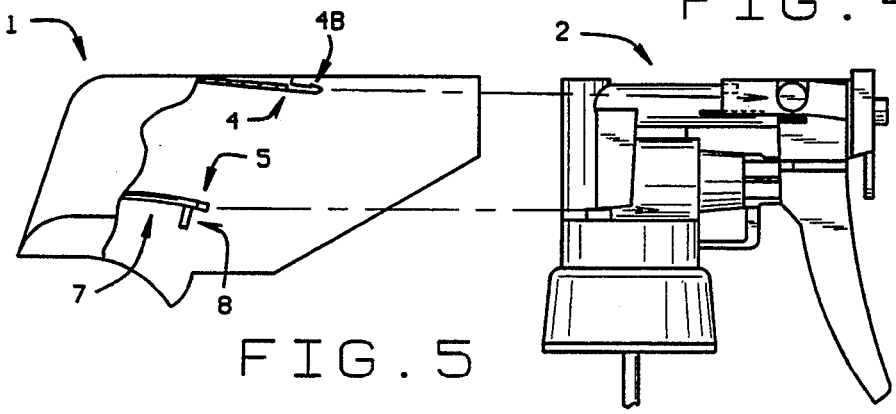
FIG. 5. The orientation of housing 1 as it is attached to fluid dispensing apparatus 2 is shown in FIG. 5. Housing 1 is associated with the fluid dispensing apparatus via movement towards the assembly along the broken lines.

With reference now to FIGS. 4 and 5, housing 1 is attached to fluid dispensing apparatus 2 by projecting members 4, 4' extending longitudinally with respect to housing 1. Projecting members 4, 4' are preferably molded integrally with housing 1. The projecting members each have a fixed end 4A, 4A' connected to the body of housing 1. The projecting members terminate in bayonet-style snap connectors 4B, 4B', which are adapted to engage corresponding receptacles in the fluid dispensing apparatus. (It is particularly preferred, in the embodiment of the present invention wherein the housing is attached to the fluid dispensing apparatus, to use a fluid dispensing apparatus substantially identical to that shown in FIGS. 1 and 5. This type of fluid dispensing apparatus is described in further detail in U.S. Pat. No. 4,958,754, issued Sep. 25, 1990, now allowed, the disclosure of which is hereby expressly incorporated herein by reference.)

In addition to being connected to housing 1 by fixed ends 4A, 4A', the projecting members may be connected to the housing along their longitudinal extent, provided that connectors 4B and 4B' project beyond the extent of any such connection in order to permit their engagement by the corresponding receptacles in the fluid dispensing apparatus. In particular, it may be desireable to form projecting members 4, 4' such that they are each connected to the main body of housing 1 along both the horizontal and the vertical axes of their longitudinal extent. This will have benefit in terms not only of mechanical strength, but also with regard to the tightness with which the housing is held against the fluid dispensing apparatus, thereby enhancing the unitary appearance which is an object of the present invention.

In a preferred embodiment, projecting members 4, 4' comprise a first pair of connectors, and the housing includes a second pair of connectors 5, 5'. In the particular configuration shown in FIG. 4, connectors 5, 5' are integral with a centering means comprising horizontal member 7, to be discussed further below. However, this is not essential, and the second pair of connectors may be provided in any convenient manner, such as by simply molding them out from the side walls of the housing.

Figure 3:
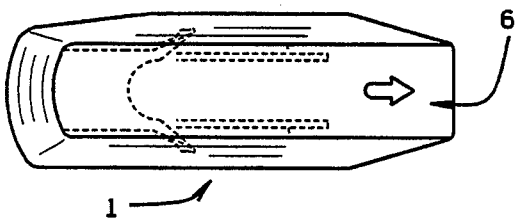
FIG. 3.

As shown in FIGS. 3 and 4, housing 1 may be further attached to fluid dispensing apparatus 2 by means of discontinuity 6, which is adapted to engage a matching protrusion on the upper surface of the fluid dispensing apparatus. While the discontinuity is shown here in the form of an aperture in the surface of housing 1, it may alternatively constitute a raised area of the surface of the housing defining a hollow into which the matching protrusion fits when the housing is attached to the fluid dispensing apparatus.

The discontinuity may be of any desired shape, and may be an indicia, such as an arrow as shown in FIGS. 3 and 4. While the indicia may be purely decorative, it may be used to display a trade mark or logo associated with the manufacturer or retailer. Alternatively, the indicia may convey information to the consumer such as, in the case of the arrow shown in FIGS. 3 and 4, a reinforcing safety message reminding the user of the direction in which the fluid in the fluid container will be directed when the trigger is actuated.

While not essential for proper functioning of the housing according to the present invention, it may be desired to further secure the fit of the housing to the fluid dispensing apparatus by providing, in the interior configuration of the housing, means for centering the housing on the fluid dispensing apparatus. This will both increase the mechanical integrity of the fit between the housing and the fluid dispensing apparatus, thereby improving the ergonomics of the feel of the dispenser to the user, and enhance the unitary appearance of the finished product by ensuring that the housing is symmetrically seated with respect to the fluid dispensing apparatus and fluid container.

As shown in dotted lines in the top perspective of FIG. 3, and in solid lines in the bottom perspective of FIG. 4, the centering means may consist of a horizontal member 7. While the horizontal member may be connected to the side walls of the housing, to the rear wall, to a rear bottom surface of the housing, or to any combination thereof, in order to maximize the mechanical strength and rigidity of the housing it is preferred to have the connecting means attached to all three. The horizontal member can further comprise at least one vertical member 8 extending generally downward from the lower surface of the horizontal member to a lower portion of the housing.

Of course, the particular configuration shown in FIGS. 3 and 4 and described herein is merely illustrative of the present invention, and a wide variety of configurations may be used without departing from the scope thereof.

Figure 6A:
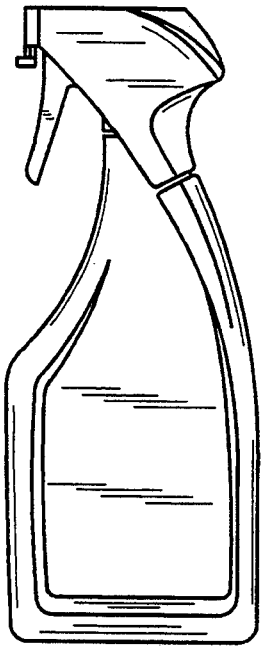
FIGS. 6A and 6B.
Figure 6B:
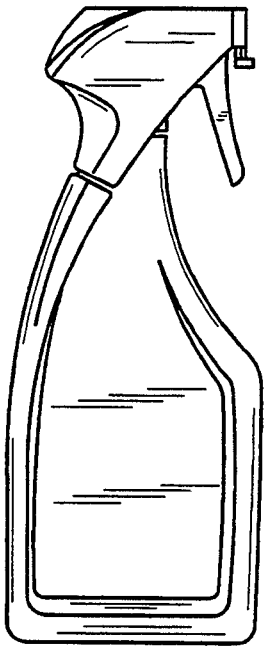
Figure 7A:
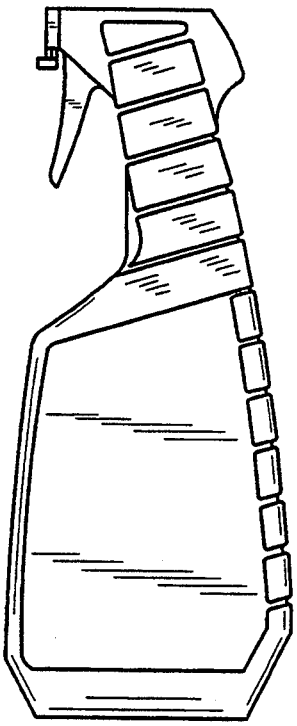
FIGS. 7A and 7B.
Figure 7B:
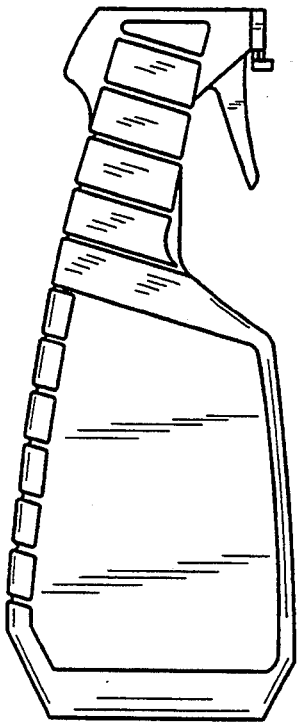

As may be seen more clearly by reference to FIGS. 6 and 7, by means of the present invention the housing and fluid container may be configured so as to complement each other. By extending the housing downward over both the coupling and the upper portion of the container, and by selecting the color and configuration of the housing to complement that of the fluid container, a visual matching of housing and container may be achieved. This presents the consumer with an attractive appearance which enhances the marketability of the product, and which allows the product to be easily customized to meet particular needs. At the same time, the interior configuration may be kept relatively uniform to minimize manufacturing expenses and maximize adaptability of the housing to a wide range of fluid dispensers.

This is in contrast to the prior art, including CARY et al., U.S. Pat. No. 4,257,539, in which the housing extends no further than the upper surface of the coupling connecting the fluid dispensing apparatus to the fluid container. Moreover, whereas CARY et al. require the use of means such as ultrasonic welding to affix the housing to the fluid dispensing apparatus, according to the present invention satisfactory attachment can be obtained simply by fitting the housing onto the assembly by means of the snap action connectors.

While FIGS. 4 and 5 show a housing configuration designed to substantially resemble the color and shape of the fluid container, it is also within the scope of the present invention to render the configuration of the housing complementary to that of the fluid container. For example, the housing may complete a pattern, color scheme, or even drawing or picture started on the container, rather than matching it. The housing could thus be shaped and/or colored to comprise the head of an animal or human figure, with the fluid container making up the body of the figure. Alternatively, the housing could complete a shading or pattern of colors started on the container. Numerous such variations and combinations may be achieved without departing from the scope of the present invention.

The present invention has of necessity been discussed herein by reference to certain specific methods, materials, and configurations. It is to be understood that the discussion of these specific methods, materials, and configurations in no way constitutes any limitation on the scope of the present invention, which extends to any and all alternative methods, materials, and configurations suitable for accomplishing the ends of the present invention.

What we claim is:

1. A housing for use with a fluid dispensing apparatus adapted for attachment to a fluid container using a snap-action coupler, said housing comprising means for attaching said housing to the fluid dispensing apparatus, said housing further comprising a lower portion configured to extend generally downward over the snap-action coupler and at least partially over the circumference of an upper portion of the fluid container when said housing is attached to the fluid dispensing apparatus and the fluid dispensing apparatus is coupled to the fluid container, wherein at least said lower portion of said housing is configured to substantially complement that portion of the fluid container adjacent said lower portion of said housing when said housing is attached to the fluid dispensing apparatus and the fluid dispensing apparatus is coupled to the fluid container, and wherein said means for attaching comprise at least one projecting member extending longitudinally with respect to said housing, said at least one projecting member having a fixed end connecting said at least one projecting member to said housing and a free end adapted to engage the fluid dispensing apparatus.

2. The housing as defined by claim 1, wherein said free end of said at least one projecting member comprises a snap-action fitting.

3. The housing as defined by claim 2, wherein said snap-action fitting comprises a bayonet-type connection.

4. The housing as defined by claim 1, comprising two projecting members.

5. The housing as defined by claim 4, wherein said two projecting members are laterally spaced from the longitudinal axis of said housing.

6. The housing as defined by claim 5, wherein said two projecting members are symmetrically positioned with respect to the longitudinal axis of said housing.

7. The housing as defined by claim 4, wherein said two projecting members comprise a first pair of projecting members, said housing further comprising a second pair of projecting members.

8. The housing as defined by claim 7, wherein said first pair of projecting members and said second pair of projecting members are laterally spaced from, and symmetrically positioned with respect to, the longitudinal axis of said housing.

9. The housing as defined by claim 8, wherein said second pair of projecting members is located in the interior of said housing beneath the level of said first pair of projecting members.

10. A housing for use with a fluid dispensing apparatus adapted for attachment to a fluid container using a snap-action coupler, said housing comprising means for attaching said housing to the fluid dispensing apparatus, said housing further comprising a lower portion configured to extend generally downward over the snap-action coupler and at least partially over the circumference of an upper portion of the fluid container when said housing is attached to the fluid dispensing apparatus and the fluid dispensing apparatus is coupled to the fluid container, wherein at least said lower portion of said housing is configured to substantially complement that portion of the fluid container adjacent said lower portion of said housing when said housing is attached to the fluid dispensing apparatus and the fluid dispensing apparatus is coupled to the fluid container, and further comprising means for centering said housing on the fluid dispensing apparatus, said means for centering comprising a horizontal member extending from the interior of said housing, said horizontal member having a front-facing surface adapted to conform to a rear-facing surface of the fluid dispensing apparatus by engagement of said front-facing surface with the rear-facing surface upon attachment of said housing to the fluid dispensing apparatus.

11. The housing as defined by claim 10, wherein said horizontal member comprises a substantially U-shaped front-facing end terminating in two free arms, the ends of said two free arms comprising a second pair of projecting members.

12. The housing as defined by claim 10, wherein said horizontal member is integral with said housing along at least a portion of its lateral edges.

13. The housing as defined by claim 12, wherein said horizontal member is further integral with the rear wall of said housing.

14. The housing as defined by claim 12, wherein said horizontal member further comprises at least one vertical member extending generally downward from the lower surface of said horizontal member to a lower portion of said housing.

15. A dispensing apparatus comprising:

a) the housing as defined by claim 9, said housing comprising means for centering said housing on said fluid dispensing apparatus, said means for centering comprising a horizontal member extending from the interior of said housing, said housing being attached by said first and second pair of projecting members to;

b) a trigger-type fluid dispensing apparatus, said fluid dispensing apparatus being adapted for attachment to a fluid container using a snap-action coupler, wherein said horizontal member comprises a substantially U-shaped front-facing surface adapted to conform to a rear-facing surface of said fluid dispensing apparatus, whereby said housing is centered on said fluid dispensing apparatus by engagement of said front-facing surface with said rear-facing surface when said housing is attached to said fluid dispensing apparatus, and further wherein said front-facing surface terminates in two free arms, the ends of said two free arms comprising said second pair of projecting members and being engaged in suitably positioned and configured receptacles on said fluid dispensing apparatus.

* * * * *